United States Patent [19]

Conly et al.

[11] 4,335,952

[45] Jun. 22, 1982

[54] COPY QUALITY DIAGNOSTIC PROCEDURE

[75] Inventors: Douglas J. Conly; David D. Larson, both of Boulder, Colo.; Stanley T. Riddle, Tucson, Ariz.

[73] Assignee: International Business Machines Corporation, Armonk, N.Y.

[21] Appl. No.: 186,093

[22] Filed: Sep. 11, 1980

[51] Int. Cl.[3] ..... G03G 15/00

[52] U.S. Cl. ..... 355/14 R

[58] Field of Search ..... 355/14 R, 14 C, 3 R, 355/77

[56] References Cited

U.S. PATENT DOCUMENTS

| | | | |
|---|---|---|---|
| 3,936,180 | 2/1976 | Willard et al. | 355/14 R X |
| 4,162,396 | 7/1979 | Howard et al. | 355/14 R X |
| 4,181,429 | 1/1980 | Batchelor et al. | 355/14 R X |

OTHER PUBLICATIONS

*IBM Tech. Disc. Bull.,* "Copy Quality Check Control Modes for an Electrophotographic Copier", vol. 21, No. 11, Apr. 1979, pp. 4387-4391.

*Primary Examiner*—R. L. Moses

*Attorney, Agent, or Firm*—Carl M. Wright

[57] ABSTRACT

Copy sheets produced by varying copier machine subsystems for analyzing subsystems' performance. By varying parameters, sequencing the coronas, and inhibiting the various subsystems of a copy machine in certain orders, the resulting copy sheets can be analyzed for indications of the subsystems' efficiency. The order of operation reduces or eliminates the subsystems interacting effects so that the degradated operation of a particular subsystem can be perceived.

5 Claims, 8 Drawing Figures

COPY QUALITY DIAGNOSTIC PROCEDURE

DESCRIPTION

Documents Incorporated by Reference

The following U.S. patents (assigned to the same assignee as this application) are hereby incorporated by reference. U.S. Pat. No. 4,170,414 shows the details of a microprocessor of the type suitable for practicing the invention herein and employs the instruction repertoire of the illustrative programs included herewith to demonstrate and to describe a preferred embodiment of the invention. U.S. Pat. No. 4,163,897 shows the details of an electrophotostatic copier in which the invention is useful and illustrates control of such a copier using a microprocessor-based system.

TECHNICAL FIELD

This invention relates to the testing of the operation of an electrophotostatic type of copier, and particularly to the diagnosis of the electrophotostatic subsystems of such copiers.

With time and use, the subsystems of copiers, such as the photoconductor, coronas, fusers, erase lamps, and so on, gradually become less efficient. As a result, the copy quality deteriorates until a catastrophic failure occurs or unacceptable copies are produced. It is more desirable to be able to check periodically the conditions of the subsystems so that preventive measures can be taken to prevent the extra costs associated with catastrophic failures as well as the loss or customer good will caused by the deterioration of copy quality.

To be cost-efficient, the expense and time required to perform such tests must be low enough to warrant their extra cost. The use of microprocessor-based controllers permits the control sequences of such machines to be altered inexpensively and functions to be added that if added to hardwired controllers would be too complex and expensive to be economically feasible. By providing the capability to make test copy sheets while varying the parameters of the controlled machine as described herein, maintenance personnel can quickly and simply determine the condition of the electrophotostatic subsystems of a machine and make necessary adjustments or replace parts as needed to keep the machine functioning at a high level of efficiency.

BACKGROUND ART

Present copy quality testing methods include predominantly the use of an original document having special patterns, similar to those of a television test pattern. The patterns are copied and the bandwidth of the system is estimated by the amount of resolution in converging fine line patterns and the accuracy of reproduction of varying gray scales.

Automatic testing of copier mechanisms is shown in the prior art. For example, U.S. Pat. No. 4,162,396 (Howard et al.: "Testing Copy Production Machines"), assigned to the same assignee as the present application, shows testing of copy machine component parts for maintenance purposes. It does not show, however, the testing of the electrophotostatic subsystems of the machine.

DISCLOSURE OF THE INVENTION

In accordance with the present invention, a method is set forth for testing an electrophotostatic copier having a photoconductor, for receiving during an imaging cycle, optical images from an expose lamp. The test method comprises operating the copier with a white original input document to be copied, turning off the expose lamp after the imaging cycle begins, and developing a resulting copy sheet which, if the copier is properly functioning, should reveal a white area gradually and evenly fading into black.

Steps are also taken to turn variable edge erase lamps on and off alternately to indicate their proper operation by analysis of the resulting copy sheet.

DESCRIPTION OF THE PREFERRED EMBODIMENT

Figure 8:
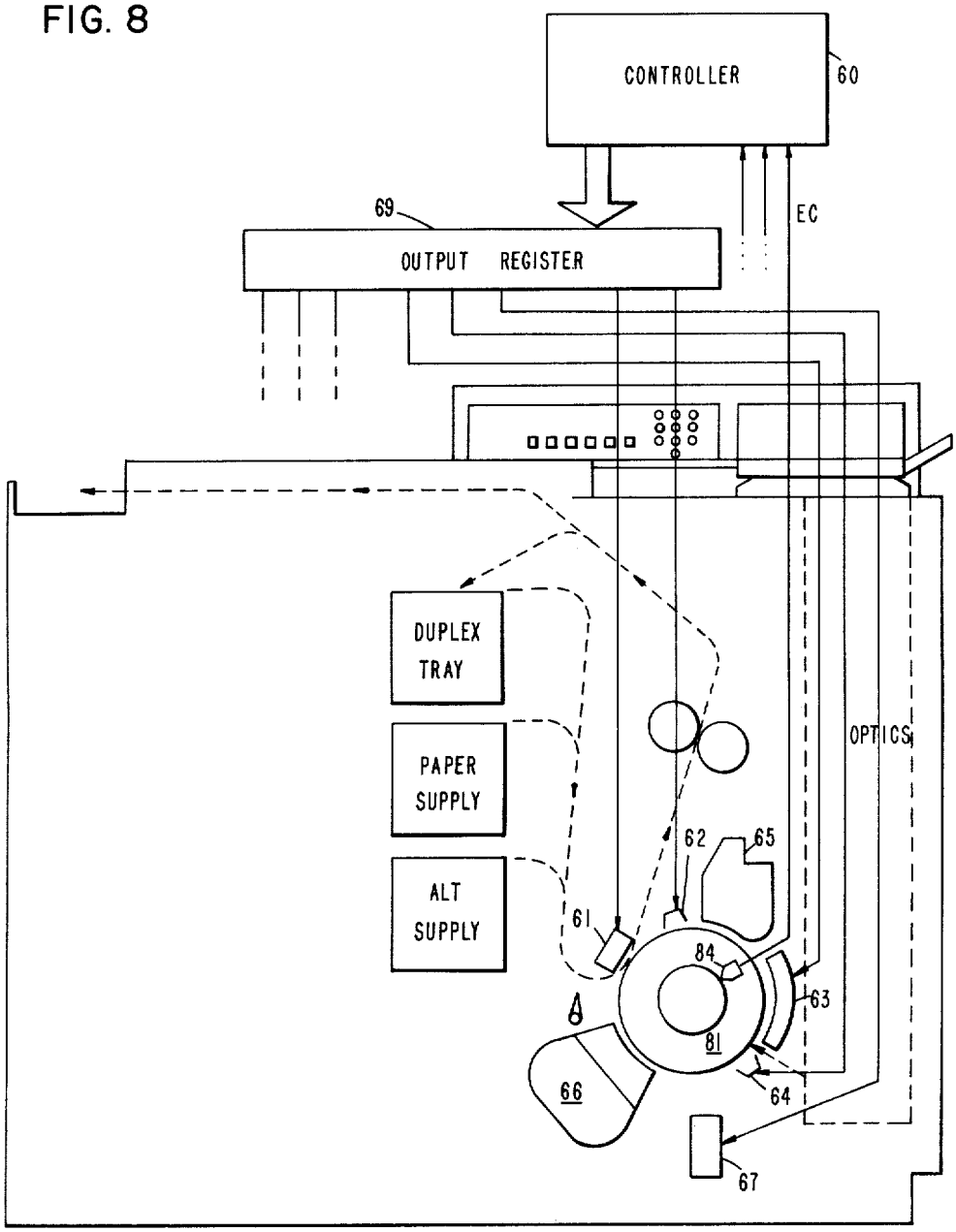
FIG. 8 is a diagram showing the connections between the controller and the copy machine subsystems being controlled.

In the embodiment to be described, a copier of the type described in U.S. Pat. No. 4,163,897, supra, is used for illustrative purposes. The subsystems pertinent to the invention to be described are shown in FIG. 8. For example, a transfer corona 61 is used to precondition the photoconductor on the drum with a negative charge. The paper on which the copy is to be made is also charged so that toner will be attracted from the photoconductor to the paper.

A preclean corona 62 also preconditions the photoconductor but with a positive charge to balance the transfer preconditioning. This charges untransferred toner in a positive direction so that it will be removed by a developer cleaner 65.

A charge corona 63 including a grid, described below, charges the photoconductor on the drum in a uniform manner which, without any discharging by the optical system, would produce a black copy. The optics normally discharge the area of the photoconductor corresponding to the white parts of the material to be copied. The charge imparted by the corona 63 is greater than the desired black level.

A backcharge corona 64, also including a grid, reduces the charge level on the photoconductor to the desired black level and imparts a positive charge to residual toner so that the latter will be removed by a developer 66.

The grid in the above-described coronas are used to insure that the black charge will be uniform and at the desired level.

Erase lamps 67 are used to discharge the boundaries of the image on the photoconductor so that resulting copies do not have black edges or margins.

Figure 7:
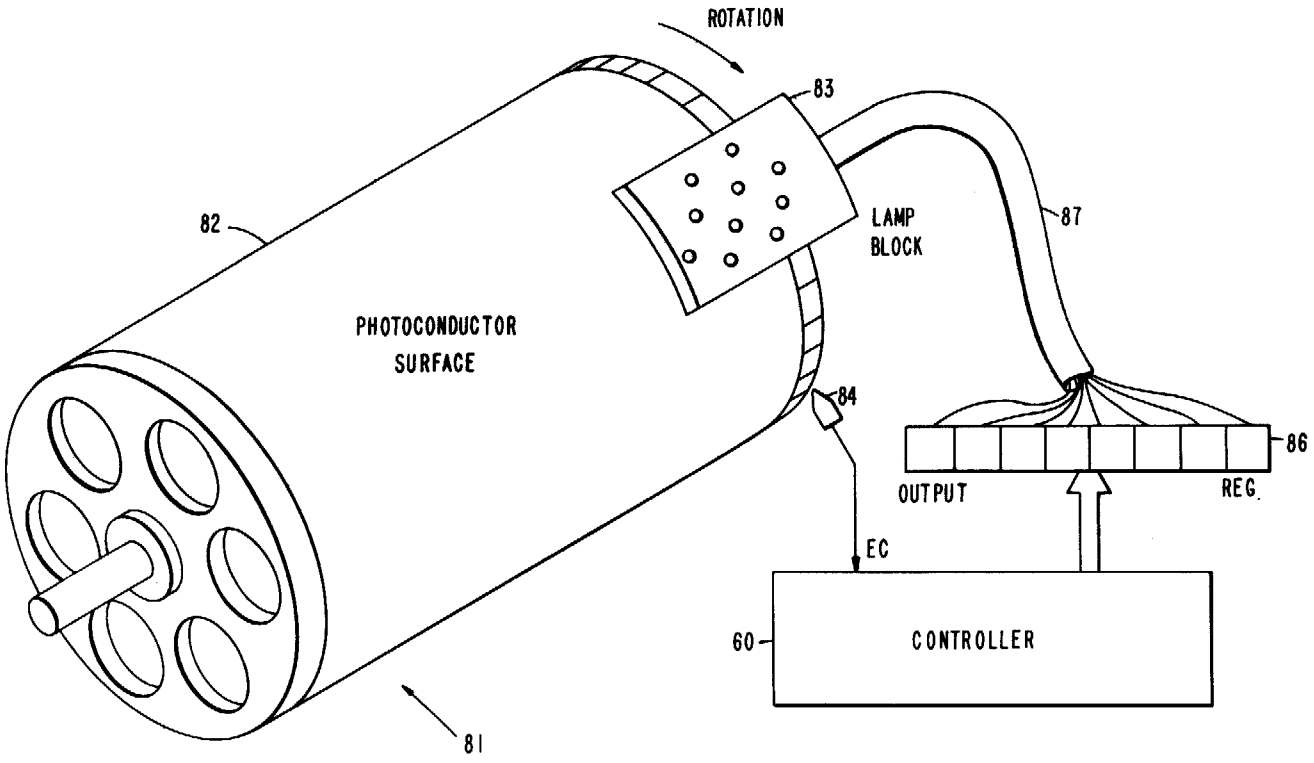
FIG. 7 is an illustration of the arrangement of the variable edge erase light-emitting diodes (LEDs).

The edge erase lamps are shown in FIG. 7 arranged in a lamp block 83 so that the light emitted by each lamp onto the photoconductor surface 82 on the drum 81 overlaps the light from the adjacent diodes. By controlling each lamp individually, the edge erasure width can be controlled. Each lamp is turned on by setting a corresponding bit in an output register 86 from a controller 60. The lamps are turned off by resetting the corresponding bits. The lamps are coupled to the output register 86 by a cable 87. A sensor 84 applies EC signals to the controller 60 as described below in more detail.

The various subsystems of the copier shown in FIG. 8 are controlled by the controller 60 which receives input signals from sensors including EC (emitter control) signals for detecting the position of the drum, temperature control signals indicating the temperature of the fuser, and so on.

The invention to be described includes the operation of the various subsystems under controlled conditions so that the effect of an individual subsystem can be determined independently from the effects of the other subsystems.

Figure 1:
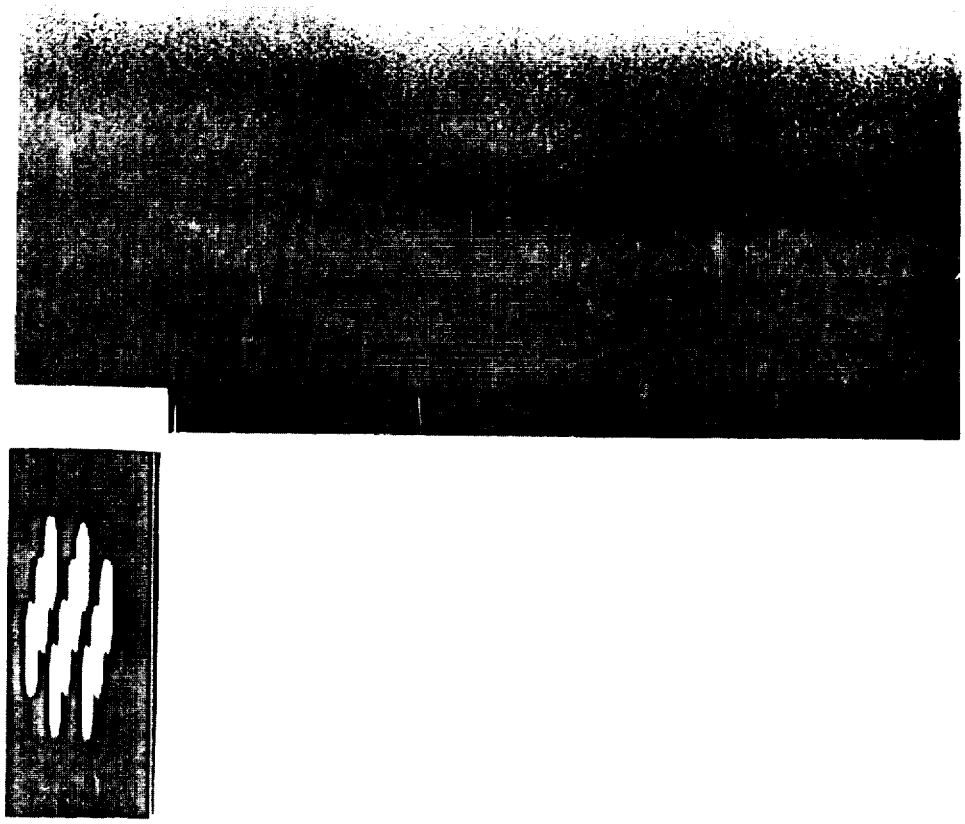
FIG. 1 is a reproduction of a first test sheet.

The tests to isolate the effects of each of the subsystems are performed by the controller in the following manner. First, a copy of a blank input image, such as a blank sheet of paper, is made with the exposure lamp turned on and then turned off to produce, if the exposure lamp is operating correctly, a white area that gradates into gray and finally black. The edge erase lamps are turned on and off in a given sequence to produce a stairstep design that will have certain characteristics if the lamps are working correctly. The copy sheet will be approximately as shown in FIG. 1 if the subsystems tested are operating correctly.

Another test is to use normal corona sequencing with the interimage lamp kept on to produce an all white copy. Residual blank spots will indicate cleaning problems.

Another test is to erase only the leading edge which will produce a black copy. Any white spots will point up photoconductor defects. These and other tests are described below in more detail.

Control of the various subsystems shown in FIG. 8 is through an output register 69 in which bits are set by the controller 60 to turn on a device or reset to turn off a device. The controller 60, and possibly the output register 69, are included in a programmable microprocessor in the preferred embodiment of the invention. An attached program listing shows suitable programs that can be executed on the processor described and shown in U.S. Pat. No. 4,170,414, incorporated herein by reference. Appendix A summarizes the instruction set of the microprocessor. The flowcharts are shown in a format called TYPICAL which is explained in Appendix B. The detailed explanations of the programs will now be covered.

Copy quality tables are used by a CZCOUNT subroutine to produce the test copies. The first test copy is produced by turning off the expose lamp so that the copy fades from white through gray shades to black. The edge erase lamps are sequenced on and off to produce a characteristic pattern and then all are turned on. FIG. 1 is a representation of the general appearance of the first test copy. The events occur in this particular embodiment as follows (measurements are from the leading edge of the copy sheet):

000 to 115 mm—white fades to black as expose lamp goes off;
115 to 125 mm—2-up erase on only;
125 to 210 mm—main erase on, 2-up strip visible;
128 to 210 mm—edge erase stairstep; and
210 to end—all erase lamps on.

The second test copy sheet is produced while varying various parameters of the electrophotostatic system. A series of four stripes are generated, the first stripe being white. The second stripe should be dark with streaks symmetrical about the center. The third and fourth stripes should be dark and uniform.

The events to produce this second sheet in the embodiment being described are:

000 to 070 mm—transfer and preclean on;
070 to 115 mm—transfer only;
127 to 182 mm—charge only; and
193 to 250 mm—charge and backcharge.

Figure 2:
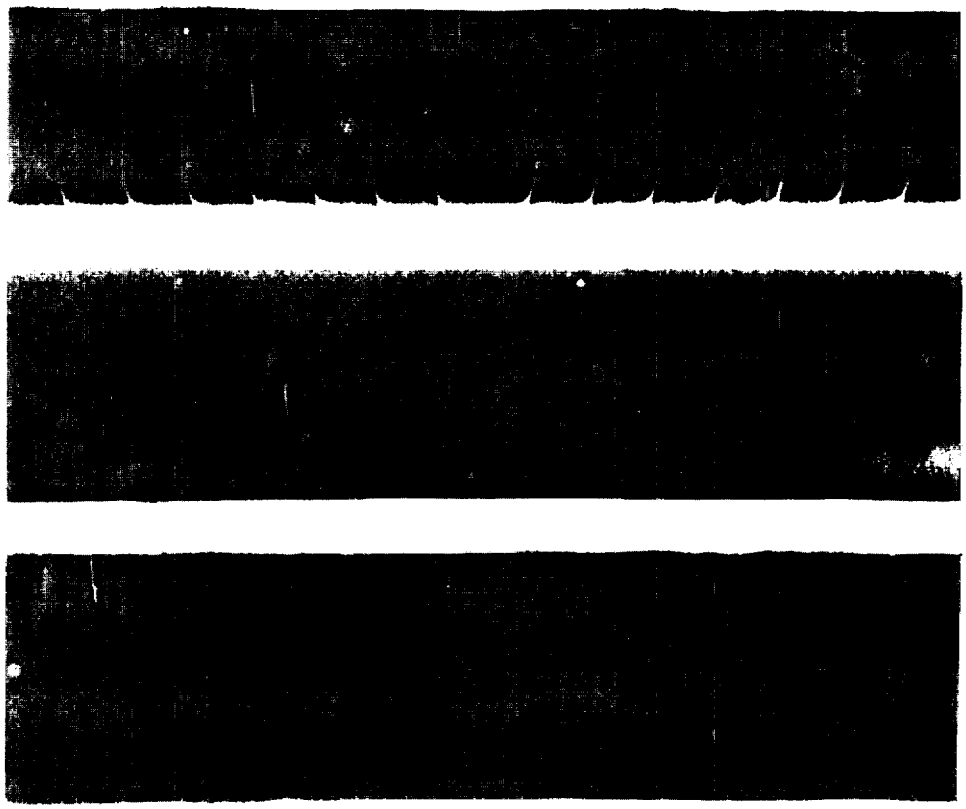
FIG. 2 is a reproduction of a second test sheet.
Figure 3:
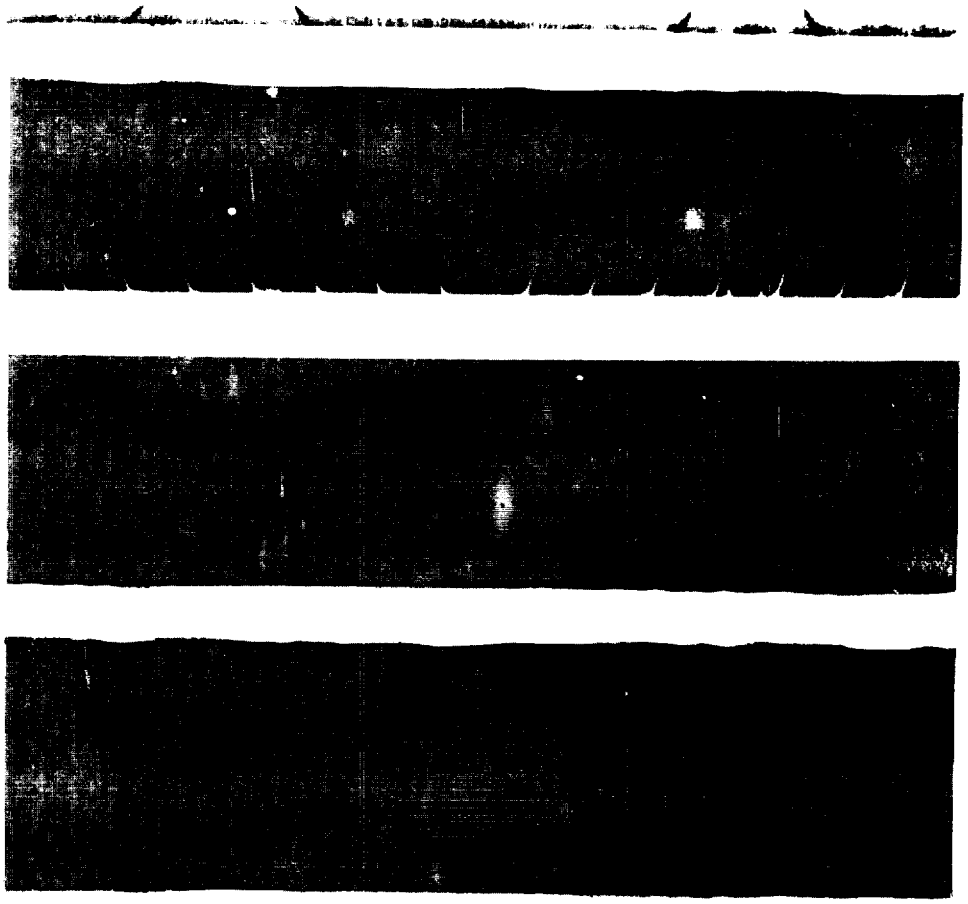
FIG. 3 is a reproduction of a third test sheet.

The third test copy sheet is produced similarly to the second but with different variations of the parameters. The first stripe should be gray with streaks that are straight and symmetrical about the center of the sheet. The second stripe should be gray and the streaks straight and symmetrical about the center. The third and fourth stripes should be gray and uniform. The general appearance of the second and third test copies are shown in FIGS. 2 and 3. The third copy test sheet is produced as follows:

000 to 070 mm—transfer normal and preclean low;
070 to 115 mm—transfer low;
127 to 182 mm—charge normal and grid low; and
193 to 250 mm—charge and backcharge normal and grid low.

Figure 4:
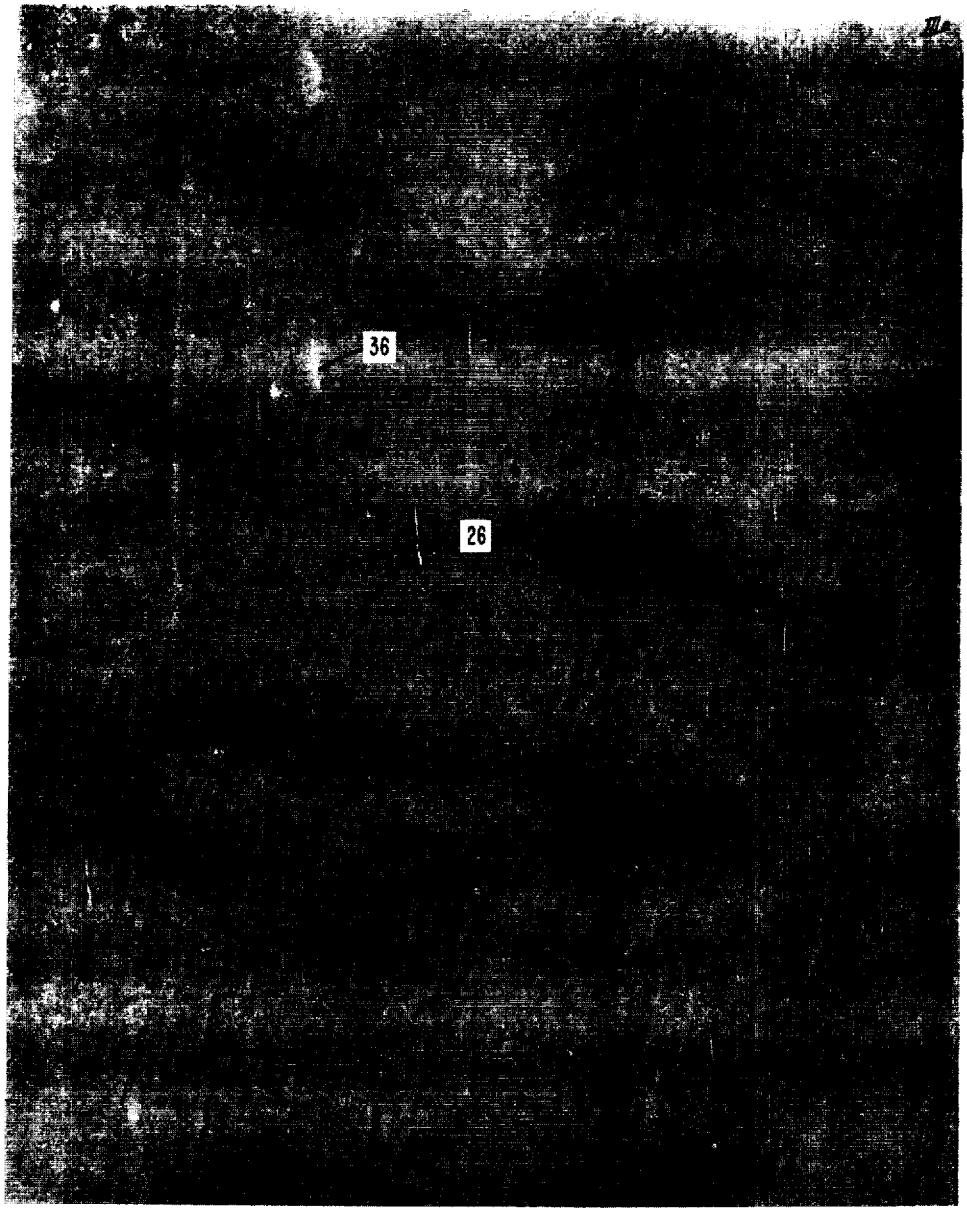
FIG. 4 is a reproduction of a test sheet 4.
Figure 5:
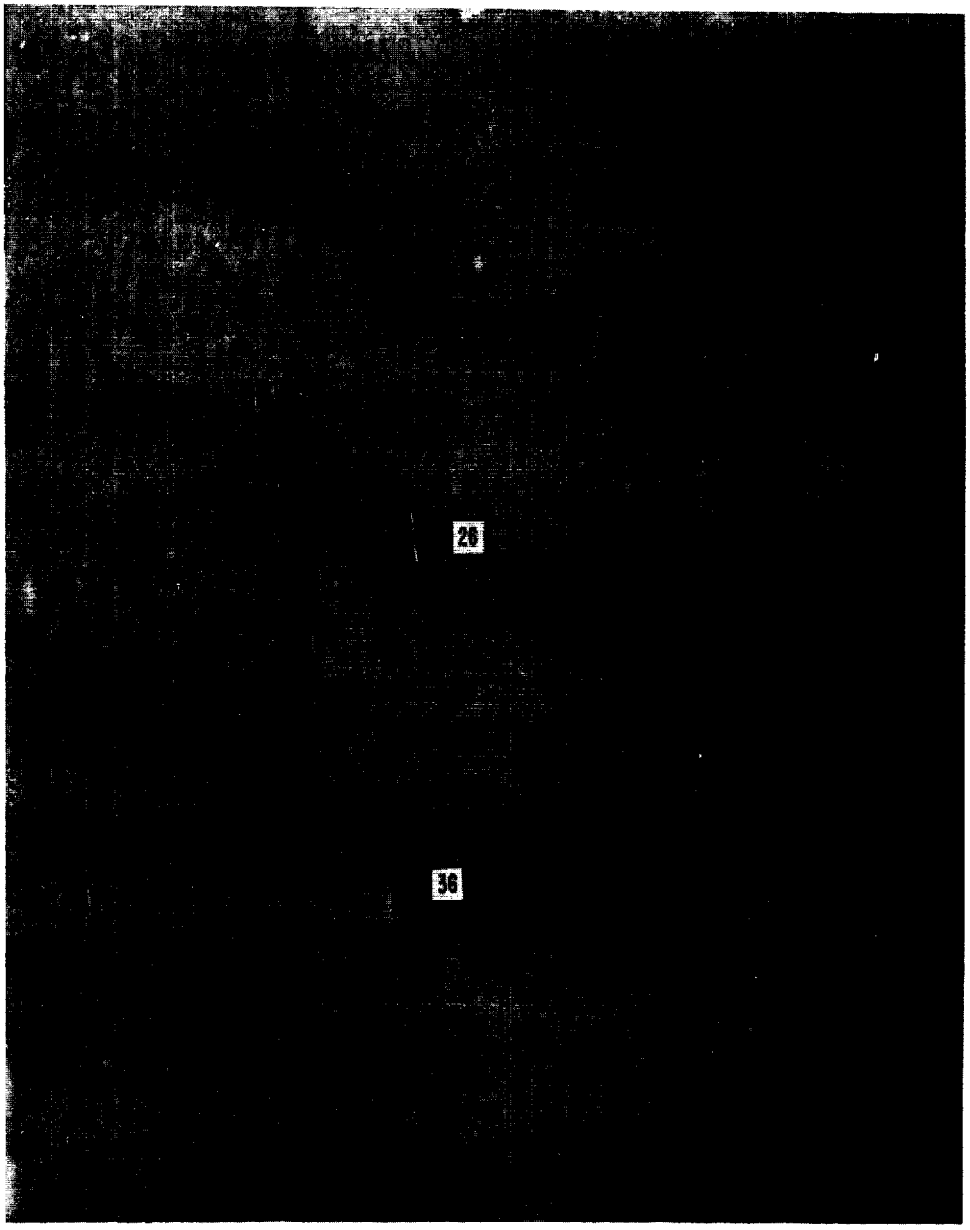
FIG. 5 is a reproduction of a test sheet 5.

Sheets 4 and 5 should both be gray and uniform, test sheet 4 being produced with the expose lamp off and no leading edge erase and sheet 5, with the expose lamp off and normal leading edge erase. The general appearance of sheets 4 and 5 is represented in FIGS. 4 and 5, respectively.

Figure 6:
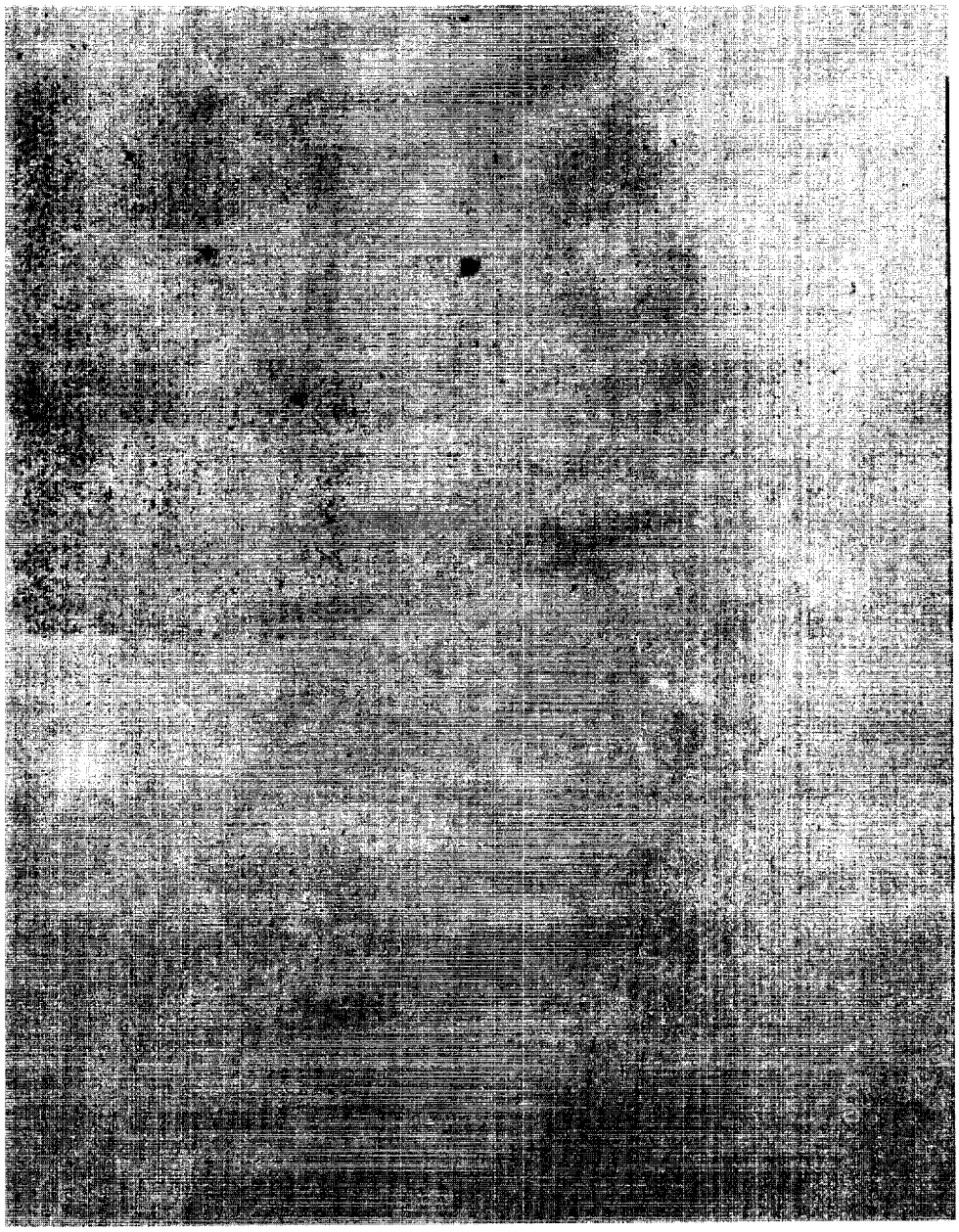
FIG. 6 is a reproduction of a test sheet 6.

The test sheet 6 is made in two sections—the first with the expose lamp and developer at low voltage and the second with the erase and developer at low voltage. The result should be gray and uniform sections. The general appearance of sheet 6 is shown in FIG. 6. A defect 26 appearing on sheets 4, 5 and 6 at the same spot indicate a bad spot on the photoconductor surface. A defect 36, appearing on all sheets but at differing locations, indicate a bad spot on the fuser roller, for example.

The analysis of the test sheets are summarized as follows. On test sheet 1, the white-to-gray transition should be the same distance from the edge of the copy across the width of the sheet. Deviations are indicative of illumination problems, such as dirty mirrors. If any erase lamps are not working, they will leave a black stripe.

On sheet 2, the bands should be white/black/black/-less black. If not, the preclean, transfer, charge, or backcharge corona (in the given order) is not working.

On sheet 3, all four bands should be gray with no density variation across the sheet. Variations point to dirty or misadjusted coronas in the same sequence as in sheet 2.

On sheet 4, if the entry guide is not properly adjusted, the leading edge on sheet 4 will have white regions. A comparison of sheets 4 and 5 showing defects in the same locations point to defects in the photoconductor. Defects having the same pattern but in differing locations on the sheet point to fuser surface defects. All other defects will indicate problems in the other subsystems, e.g., voids will indicate developer mix problems.

On sheet 6, a gray region on top is another indication of expose profile uniformity. Excessive differences between the top and bottom point to insufficient expose energy.

A CZCOUNT subroutine uses the tables, CQTAB's, to transfer to the proper test program module at the proper drum angle. Because the emitter signals from the drum are not supplied at the exact angles required for each of the tests, the CZCOUNT subroutine uses a pseudo-emitter routine which is synchronized with the drum but provides angle information in small increments. The tables are organized so that the first two bytes of a table supply the address of the beginning of the next table. The third byte is the hexadecimal value of the angle at which a test routine is to be executed and the fourth and fifth bytes supply the address of the test routine. The third, fourth and fifth bytes are repeated for each entry. The end of the table is indicated by a byte of all ones, hexadecimal FF (usually written X"FF", where the X indicates the following literals are in hexadecimal format).

In the attached program example, the first table is located beginning at memory address F4E6. The first byte, F4EF, is the address of the next table. The hexadecimal angle value 60 (decimal 96) indicates that the routine at FOB9, the next byte's contents, is to be executed when the drum is at an angle of 96-degrees. The transfer of control to these tables and to the routines is shown in the CZCOUNT subroutine of Chart I.

Chart I shows the CZCOUNT subroutine, CE ZERO-CROSS COUNTER. This subroutine maintains a computed drum angle count for maintenance and test modes and executes special function routines at the proper revolution or drum angle as programmed. Many tests require events to occur at points not available from the standard drum emitter. The pseudo-emitter, with execution tables for each drum revolution, enables these special events where required.

The pseudo-emitter routine in the CZCOUNT subroutine operates as follows. During each drum revolution, a count of powerline zero-crossovers is maintained. At the start of a drum revolution, defined herein as the leading image 81-degrees below the optical centerline, the previous count is saved and a new count is started. Approximately every 90 degrees, the drum angle estimate is corrected by an emitter routine, CZCORR (not shown in detail).

The execution tables are constructed assuming a particular design frequency (ZDESFREQ). The current zero-cross count is multiplied by the ratio ZDESFREQ/(Previous Frequency) to estimate the current drum angle.

The ratio multiplication operates as follows. Let

N = current zero cross number (counts of number of executions so far during present cycle), P = numerator of the ratio (ZDESFREQ) (number of executions per cycle for which program routine is designed), Q = denominator of the ratio (previous frequency) (total number of executions during the previous drum revolution), K = quotient of $(N \times P)/Q$, and R = remainder of $(N \times P)/Q$.

The current drum angle can be estimated by $$DEG = 360 \times N/Q \text{ degrees}$$

and the current design counts by $$CNT = DEG \times P/360$$

which can be written as $$CNT = N \times P/Q$$

Because CNT will always be a rational number, it can be expressed by integers K and R, which can be determined quite readily in digital format by repeated subtractions. Assuming that at the i-th module execution, $K_i$ and $R_i$ are known, then for the next (i+1) module execution, $$CNT_{i+1} = (N+1)P/Q$$

which can be reduced to $$CNT_{i+1} = K_i + (R_i + P)/Q.$$

Then, at zero-cross N+1, successive values of K and R are found as $$K_{i+1} = K_i + (R_i + P)/Q$$

and $$R_{i+1} = R_i + P - Q.$$

Whenever the new remainder, $R_{i+1}$, exceeds Q/2, the integer count is incremented by one and Q subtracted from the remainder.

This approach has the advantage of requiring little processing time. No more than three subtractions per loop execution are required to compute $(R_i + P_i)/Q$ whereas $N \times P/Q$, a direct computation, would require an average of 60 subtractions per loop execution.

Initially, the remainder is set to the design frequency (ZDESFREQ). On each execution, the numerator is subtracted from the remainder. Any time that the result is less than zero, the drum angle count is incremented by one.

The table decode is performed at every estimate update—once each pass through the code zero-cross loop—when the current drum angle estimate is compared to the zero-cross loop—when the current drum angle estimate is compared to the present table entry. If the estimate is greater than or equal to the table entry, the corresponding routine is executed.

The drum angle estimate is frozen whenever it reaches the design count until a counter restart is requested. At that time, the estimate is increased to design frequency plus one which will cause all unexecuted table entries to be executed, the frequency to be saved, the counter to be restarted, and a new execution table to be pointed to.

A separate table is required for each drum revolution except when table looping is used, such as when other diagnostics are using the drum angle estimator.

The set-up subroutine for the pseudo-emitter is CEANGSET, which is called by the routine setting up the CE run mode which will use the pseudo-emitter. CEANGSET is shown in Chart II.

If the design frequency is chosen to be 120 zero-crossings per revolution, then the smallest table increment (one estimate count) corresponds to three degrees of drum revolution and the formula for a table entry is (desired drum angle − 81 degrees).

The execution of the tests is now described. The subroutine CZCOUNT, shown in Chart I with the program steps keyed to the address of the attached program coding, at step 23 fetches the address of the test module to be executed depending on the angle of drum rotation. At step 26, the program branches to the test module and returns to step 27 after the completion of the test. The details for performing this transfer are shown in the attached program listing beginning at the address D47D, the addresses being given in hexadecimal modulus.

Table I is a summary of the test tables used to transfer to the correct test as determined by the number of degrees of drum rotation. The test routine starting address is given and the test functions are summarized in Table II. These tests are self-explanatory by referencing the attached program listing.

Two examples will be explained to illustrate the implementation of the tests. The first module of Table II is CECHGOFF, which turns off the charge corona. In the program listing, it is seen that a bit denoted CHGCOR in a byte denoted ACCARD2M is reset by the TR instruction. (See Appendix A.) This bit, when reset in the output register, turns off the power to the charge corona as shown in FIG. 6. The module CECHGON, starting at address EFEF, turns the charge corona on by setting the same bit discussed above. In the ouput register 69 of FIG. 6, this bit, when set, causes the charge corona to be turned on. The control of devices using bits is well known in the art and need not be explained in detail for an understanding of the invention.

By cycling through the tables and performing the modules in the order prescribed at the proper drum angle, the tests described above are executed, allowing the operator or maintenance personnel to test the various subsystems of the copy machine with the effect of each subsystem isolated from the others. In this way, the beginning of degradated operation of a subsystem can be determined before copy quality is noticably reduced or a catastrophic failure occurs.

CHART I

SUBROUTINE: CZCOUNT

| | | |
|---|---|---|
| 1. | enter | |
| 2. | reset unfulfilled start request flag | D42A |
| 3. | IF pseudo-emitter is being used | D42F |
| 4. | THEN (+1) machine frequency counter FREQREG | |
| 5. | IF counter reset flag is set | D433 |
| 6. | THEN store machine drum angle ANGLECTR | |
| 7. | clear FREQREG | D439 |
| 8. | set drum angle counter above design count | D43E |
| | ZDESFREQ | |
| | FIN 5 | |
| 9. | IF (ANGLECTR :#: ZDESFREQ) | D442 |
| | THEN | |
| 10. | IF (ANGLECTR :lt: ZDESFREQ) & | D447 |
| | (counter correction is set) | |
| | THEN | |
| 11. | CASE (ANGLECTR) | |
| 12. | : :le: 45: set count to 29, | D44E |
| 13. | : :gt: 45 & :le: 75: set count to 61, | D458 |
| 14. | :ELSE: set counter to 90. | D45F |
| 15. | store corrected count in ANGLECTR | D461 |
| 16. | set ratio counter RATIOCNT to machine frequency | D462 |
| 17. | ELSE (−ZDESFREQ)RATIOCNT | D467 |
| 18. | WHILE (RATIOCNT :le: 0) | D46B |
| 19. | (+1) ANGLECTR | D46D |
| 20. | (+machine frequency)RATIOCNT | D46F |
| | LOOP 18 | |
| | FIN 10 | |
| 21. | IF any entries remain in current pseudo-emitter | D474 |
| | execution table CURRADR | |
| | THEN | |
| 22. | WHILE (CURRADR :le: ANGLECTR) | D479 |
| 23. | fetch address of corresponding module | D47D |
| 24. | store module address | D485 |
| 25. | store return address | D489 |
| 26. | branch to module (and return) | D48F |
| 27. | point to next table entry | D490 |
| | LOOP 22 | |
| | ELSE | |
| 28. | IF not a skip cycle | D495 |

CHART I-continued

SUBROUTINE: CZCOUNT

| | | |
|---|---|---|
| | THEN | |
| 29. | IF copy is being made | D496 |
| | THEN | |
| 30. | IF (ANGLCTRL :gt: ZDESFREQ) | D4A2 |
| 31. | THEN reset ANGLECTR | D4A8 |
| 32. | (+1) revolution counter | D4AB |
| 33. | preset RATIOCNT to machine frequency | D4AD |
| 34. | fetch and store address of the first count in next table and address of following table | D4B1 |
| | FIN 30 | |
| 35. | ELSE set ANGLCTRL to ZDESFREQ | D4BC |
| | FIN 29 | |
| 36. | ELSE call PJAM to stop machine | D4C1 |
| | FIN 28 | |
| | FIN 21 | |
| | FIN 9 | |
| | FIN 3 | |
| 37. | return | |

CHART II

SUBROUTINE: CEANGSET

| | | |
|---|---|---|
| 1. | enter | |
| 2. | set DRUMANG bit (flags use of pseudo-emitter) | E595 |
| 3. | load address of a table end code ((X"FF")) | E59B |
| 4. | initialize ANGLECTR to ZDESFREQ | E5A1 |
| 5. | clear high order copy select byte CPRIME2 | E5A6 |
| 6. | select normal developer voltage | E5A9 |
| 7. | flag an after-jam run in | E5B1 |
| 8. | return | E5B9 |

TABLE I

SUMMARY OF TEST TABLES

| Table No. | Degrees | Test Routine Address |
|---|---|---|
| 1 | 96 | F0B9 |
| | 119 | F0A6 |
| 2 | 1 | F087 |
| | 3 | F07B |
| | 4 | F06E |
| | 4 | F094 |
| | 28 | F087 |
| 3 | 41 | EFE3 |
| | 45 | F02F |
| | 46 | F015 |
| | 81 | EFEF |
| | 99 | F03B |
| | 104 | F048 |
| | 106 | F055 |
| | 108 | F103 |
| | 118 | F022 |
| 4 | 1 | F048 |
| | 3 | F055 |
| | 6 | F0D8 |
| | 20 | F048 |
| | 22 | F055 |
| | 41 | F048 |
| 5 | 26 | F110 |
| | 41 | EFE3 |
| | 45 | F02F |
| | 46 | F015 |
| | 46 | F0E7 |
| | 81 | F11F |
| | 81 | EFEF |
| | 99 | F03B |
| | 104 | F048 |
| | 106 | F055 |
| | 118 | F022 |
| 6 | 1 | F048 |
| | 3 | F055 |
| | 20 | F048 |
| | 22 | F055 |
| | 41 | F048 |
| | 43 | F0F6 |
| | 61 | F0E7 |
| 7 | 85 | F055 |
| 10 | 82 | F0D0 |

TABLE I-continued

SUMMARY OF TEST TABLES

| Table No. | Degrees | Test Routine Address |
|---|---|---|
| 11 | 111 | F0F6 |
| 12 | 10 | F048 |

TABLE II

SUMMARY OF TEST ROUTINES BY ADDRESS

| Address | Mnemonic | Description |
|---|---|---|
| EFE3 | CECHGOF | Turns off charge corona |
| EFEF | CECHGON | Turns on charge corona |
| F015 | CECLNOF | Turns off clean corona |
| F022 | CECLNON | Turns on clean corona |
| F02F | CEXFROF | Turns off transfer corona |
| F03B | CEXFRON | Turns on transfer corona |
| F048 | CERASAON | Turns on interimage erase lamps |
| F055 | CERASAOF | Turns off interimage erase lamps |
| F06E | CERASMON | Turns on main bay interimage erase lamps |
| F07B | CE2UPOF | Turns off front bay interimage erase lamps |
| F087 | CE2UPON | Turns on front bay interimage erase lamps |
| F094 | CEDGEOF | Turns off edge erase lamps |
| F0A6 | CEDGEON | Turns on edge erase lamps |
| F0B9 | CEILLOF | Turns off document illumination lamp |
| F0D0 | CSETSCAN | Sets scan flags to scan during next drum revolution |
| F0D8 | CEMBCLN | Sets developer to cleaning level |
| F0E7 | CEMBNOR | Sets developer to normal level |
| F0F6 | CEMBSEAL | Sets developer to seal level |
| F103 | CEMBOFF | Turns developer power off |
| F110 | CEHVLOW | Turns on grid power (preclean, transfer) to half level |
| F11F | CEGRIDLO | Turns on grid power to normal level |

APPENDIX A

| INSTRUCTION MNEMONIC | HEX VALUE | NAME | DESCRIPTION |
|---|---|---|---|
| AB(L) | A4 | Add Byte (Low) | Adds addressed operand to LACC (8-bit op.) |
| AI(L) | AC | Add Immed. (Low) | Adds address field to LACC (16-bit op.) |
| AR | DN | Add Reg. | Adds N-th register contents to ACC (16-bit op.) |
| A1 | 2E | Add One | Adds 1 to ACC (16-bit op.) |
| B | 24,28,2C | Branch | Branch to LSB (+256, −256, ±0) |
| BAL | 30–33 | Branch And Link | Used to call subroutines (PC to Reg. 0, 1, 2, or 3) |
| BE | 35,39,3D | Branch Equal | Branches if EQ set (See B) |
| BH | 36,3A,3E | Branch High | Branch if EQ and LO are reset (See B) |
| BNE | 34,38,3C | Branch Not Equal | Branch if EQ reset (See B) |
| BNL | 37,3B,3F | Branch Not Low | Branch if LO reset (See B) |
| BR | 20–23 | Branch Reg. | See RTN |
| CB(L) | A0 | Compare Byte (Low) | Addressed byte compared to LACC (8-bit op.) |
| CI(L) | A8 | Compare Immed. (Low) | Address field compared to LACC (8-bit op.) |
| CLA | 25 | Clear Acc. | ACC reset to all zeroes (16-bit op.) |
| GI | A9 | Group Immed. | Selects one of 16 register groups (also controls interrupts) |
| IC | 2D | Input Carry | Generate carry into ALU |
| IN | 26 | Input | Read into LACC from addressed device (8-bit op.) |
| J | 0N,1N | Jump | Jump (forward or back) to PC(15–4),N |
| JE | 4N,5N | Jump Equal | Jump if EQ set (See J) |
| JNE | 6N,7N | Jump Not Equal | Jump if EQ reset (See J) |
| LB(L) | A6 | Load Byte (L) | Load addressed byte into LACC (8-bit op.) |
| LI | AE | Load Immed. | Load address field into LACC |
| LN | 98–9F | Load Indirect | Load byte addressed by reg. 8-F into LACC (8-bit op.) |
| LR | EN | Load Register | Load register N into ACC (16-bit op.) |
| LRB | FN | Load Reg./Bump | Load reg. N into ACC and increment; ACC to Reg. N (N=4–7,C–F) (16-bit op.) |
| LRD | FN | Load Reg./Decr. | Load reg. N into ACC and decrement; ACC to Reg. N (N=0–3,8–B) (16-bit op.) |

APPENDIX A-continued

| INSTRUCTION MNEMONIC | HEX VALUE | NAME | DESCRIPTION |
|---|---|---|---|
| NB(L) | A3 | And Byte (Low) | AND addressed byte into LACC (8-bit op.) |
| NI(L) | AB | And Immed. (Low) | AND address field into LACC (8-bit op.) |
| OB(L) | A7 | Or Byte (Low) | OR addressed byte into LACC (8-bit op.) |
| OI(L) | AF | Or Immed. (Low) | OR address field into LACC (8-bit op.) |
| OUT | 27 | Output | Write LACC to addressed device |
| RTN | 20-23 | Return | Used to return to calling program (See BAL) |
| SB(L) | A2 | Subtract Byte (Low) | Subtract addressed byte from LACC (8-bit op.) |
| SHL | 2B | Shift Left | Shift ACC one bit left (16-bit op.) |
| SHR | 2F | Shift Right | Shift ACC one bit right (16-bit op.) |
| SI(L) | AA | Subtract Immed. (Low) | Subtract address field from LACC (16-bit op.) |
| SR | CN | Subtract Reg. | Subtract reg. N from ACC (16-bit op.) |
| STB(L) | A1 | Store Byte (Low) | Store LACC at address (8-bit op.) |
| STN | B8-BF | Store Indirect | Store LACC at address in Reg. 8-F |
| STR | 8N | Store Reg | Store ACC in Reg. N (16-bit op.) |
| S1 | 2A | Subtract One | Subtract 1 from ACC (16-bit op.) |
| TP | 9N | Test/Preserve | Test N-th bit in LACC (N=0-7) |
| TR | BN | Test/Reset | Test and reset N-th bit in LACC |
| TRA | 29 | Transpose | Interchange HACC and LACC |
| XB(L) | A5 | XOR Byte (Low) | Exclusive-OR addressed byte into LACC (8-bit op.) |
| XI(L) | AD | XOR Immed. (Low) | Exclusive-OR address field into LACC (8-bit op.) |

Notes:
ACC (Accumulator) is 16-bit output register from arithmetic-logic unit
LACC signifies herein the low ACC byte; HACC, the high byte
all single byte operations are into low byte
register operations are 16-bit (two-byte)
8-bit operations do not affect HACC
EQ (equal) is a flag which is set:
if ACC=0 after register AND or XOR operations;
if ACC (low byte)=0 after single byte operation;
if a tested bit is 0;
if bits set by OR were all 0's;
if input carry = 0;
if compare operands are equal;
if bit shifted out of ACC = 0;
if 8th bit of data during IN or OUT = 0.
LO (low) is a flag which is set: (always reset by IN, OUT, IC)
if ACC bit 16=1 after register operation;
if ACC bit 8=1 after single byte operations;
if logic operation produces all ones in LACC;
if all bits other than tested bit = 0;
if ACC=0 after shift operation;
if compare operand is greater than ACC low byte.

| MACRO MNEMONIC | NAME | DESCRIPTION |
|---|---|---|
| BC | Branch on Carry | Branches if carry is set |
| BCT | Branch on Count | Reg. decremented and branch if not zero result |
| BHA | Branch on High ACC | Used after compare |
| BL | Branch on Low | Branches if LO is set |
| BLA | Branch on Low ACC | See BNC; used after compare |
| BNC | Branch Not Carry | Branches if carry is reset |
| BNLA | Branch on Not Low ACC | See BC; used after compare |
| BNZ | Branch Not Zero | Branches if previous result was not zero |
| BR | Branch via Register | Same as RTN instruction |
| BU | Branch Unconditionally | Same as BAL instruction |

-continued

| MACRO MNEMONIC | NAME | DESCRIPTION |
|---|---|---|
| CIL | Compare Immed. Low | Uses low byte of indicated constant in CI address field |
| DC | Define Constant | Reserves space for constant |
| EXP2 | Express In powers of 2 | Opcode set to binary |
| JC | Jump on Carry | See BC |
| JL | Jump on Low | See BL |
| JNC | Jump on No Carry | See BNC |
| JNH | Jump Not High | See BNH |
| LA | Load Address | Generates sequence LIH, TRA, LIL |
| LBD | Load Byte Double | Bytes at addr. and addr. +1 to ACC |
| LID | Load Immed. Double | Same as LA |
| LIH | Load Immed. High | Uses high byte of constant in LI address field |
| LIL | Load Immed. Low | Uses low byte of constant in LI address field |
| NOP | No Operation | Dummy instruction - skipped |
| RAL | Rotate ACC Left | Generates sequence SHL, IC, AI |
| SCTI | Set Count Immed. | Generates CLA, LI, STR |
| SHLM | Shift Left Multiple | Shifts specified number of times to left |
| SHRM | Shift Right Multiple | Shifts specified number of times to right |
| SRG | Set Register Group | Same as GI |
| STDB | Store Byte Double | ACC to addr. +1 and addr. |
| TPB | Test & Preserve Bit | Generates sequence LB, TP |
| TRB | Test & Reset Bit | Generates sequence LB, TR, STB |
| TRMB | Test & Reset Multiple Bits | Same as TRB but specifies multiple bits |
| TRMR | Test/Reset Mult. Bits in Reg. | Generates LR, NI, STR |
| TS | Test and Set | Same as OI instruction |
| TSB | Test & Set Byte | Same as TS but byte is specified in addition to bit |
| TSMB | Test & Set Multiple Bytes | Same as TS but specifies multiple Bits |
| TSMR | Test & Set Mult. Bits in Reg. | Generates LR, OI, STR |
| LZI | Zero & Load Immed. | Generates CLA, LI |

NOTES:
(Label) DC *causes the present location (*) to be associated with the label.
L and H, in general, are suffixes indicating low or high byte when 16 bit operands are addressed.

APPENDIX B

Summary of Typical

Each step 1. comprises one or more lines,
2. is consecutively numbered,
3. may comprise more than one statement, each separated by semicolons,
4. may be labelled with a label extending at least two spaces to the left of the statements, followed by a semicolon, and
5. can be merely a branch (unconditional).

The relational *operators* are:

| | |
|---|---|
| less than | :lt: |
| less than or equal to | :le: |
| greater than | :gt: |
| greater than or equal to | :ge: |
| equal to | :=: |
| not equal to | :#: |
| equivalence | :eqv: |
| implication | :imp: |

Special symbols:

()—signifies, when enclosing a step number or label, a branch to the step; modification expression to be applied to a following variable or register without changing the position of the variable or register; signifies, when enclosing a register name or mnemonic, the contents of the register if confusion would otherwise result.

(())—signifies the address of the enclosed variable.

X—indicates that a following literal string is represented in hexadecimal.

;—separates statements; separates indices of different dimensions.

:—indicates a comparative test; separates a label from a following statement; sets off relational operators.

?—follows and identifies a test statement.

"—encloses a string of literals.

Upper case letters are used for variable mnemonics and key words of special statements.

Lower case underlined letters are used for reserved words having a predetermined function.

Test Statements:

A test statement (decision block) can be either of two types, *logical* or *comparative*. A test statement is identified by a following question mark and parentheses enclosing the step to which a branch is to be taken depending on the test results.

A *logical* test is expressed using logical expressions and logical and relational operators. The logical expressions may contain any type operator and variable. The question mark after the test is followed by a step number or label in parentheses indicating the step to which a branch is taken if the test result is true. If the parentheses are followed by a NOT operator (′), the step indicated is branched to if the test result is false.

A *comparative* test is indicated by a colon separating left-hand and right-hand expressions. The question mark after the test is followed by three step numbers or labels separated by commas and enclosed in parentheses. The expressions are evaluated and their values compared. The first step is branched to if the left-hand value is less than the right-hand value. The second step is branched to if the left- and right-hand values are equal. The third step is branched to if the left-hand value is greater than the right-hand value. A minus sign in place of a step number or label indicates the following step.

Special Statements:

Three special statements are provided for handling conditional decisions and for looping through sequences of statements under given conditions. These special statements are actually ways of writing commonly used sequences of statements that occur frequently in most programs. The key words of the special statements are written in upper case letters.

In the following explanations, s1, s2, . . . , sn, sm represent statements or sequences of statements.

The conditional statements are the IF-THEN statements and the CASE statements.

IF-THEN Statements:

The form of the statement is

IF (conditional statement) THEN s1 ELSE s2 FIN

The statements s1 are executed if the conditional statement is true and the statements s2 are executed if the conditional statement is false.

The ELSE s2 is optional, and if omitted, a false conditional statement will cause the statements s1 to be skipped and the program to continue with the steps following FIN.

FIN is used to terminate the IF-THEN statement because s1 or s2 can constitute an arbitrary number of statements.

CASE Statements:

The form of the statement is

CASE (expression)
:(value 1): s1,
:(value 2): s2,
. . .
:(value n): sn,
:ELSE: sm.

The expression is evaluated and the statements associated with the value of the expression are executed, the other statements being skipped.

The ELSE is optional. If the value of the expression is not covered by the CASE statement values and the ELSE is omitted, program execution continues with the statements after the CASE statement which is terminated by a period. A comma identifies the end of the statements associated with a given value.

The CASE statement eliminates the sequence of several IF-THEN statements that would otherwise have to be written to execute a given series of statements associated with a particular value of the expression.

The looping on condition statement is the WHILE-LOOP statement.

WHILE-LOOP Statements:

The form of the statement is

WHILE (conditional statement) s1 LOOP

The conditional statement is tested and if true, the statements s1, terminated by the key word LOOP, are executed and the process repeated. If the conditional statement is false, then the statements s1 are skipped and program execution continues with the steps following LOOP.

The key words of the special statements should be written on separate lines if the entire statement is too long for one line. Two key words should not otherwise be written on the same line. If a key word is not followed by an executable statement, the line is not numbered.

Indentations may be used to improve the readability of the program but many indentations become a problem, especially when labels are used. The reading of the program can be aided by writing after the terminal key words FIN or LOOP, the step number of the related key word.

Definitions and Reserved Words:

The words *enter* and *return* are the delimiters for subroutines invoked by *call*. The *return* statement in the subroutine causes a branch to the calling routine to the step following the invoking call. There may be more than one *return* statement in a subroutine.

The *call* indicates a branch, with required linking of parameters, to the named subroutine. If required for clarity, the subroutine input parameters are listed after the name of the subroutine separated by commas and terminated with a semicolon. The output parameters being returned to the calling program follow the semicolon and are separated by commas if more than one. The parameters are enclosed in parentheses.

Various modifications to the systems and circuits described and illustrated to explain the concepts and modes of practicing the invention can be made by those of ordinary skill in the art within the principles or scope of the invention as expressed in the following claims.

What is claimed is:

1. In a copier of the electrophotostatic type, having a photoconductor means for receiving during an imaging cycle optical images from an expose lamp means and a plurality of variable edge erase lamp means for providing selectively erasable edges, a method for testing proper operation of subsystems of said copier comprising the steps of:

operating said copier with a blank input image to be copied;

turning off said expose lamp after said imaging cycle begins; and developing a resulting copy sheet in a normal manner, whereby said copy sheet should show a blank area gradually and evenly fading into black when said expose lamp means is functioning properly.

2. The invention as claimed in claim 1 including, before said turning off step, the further step of sequencing on and off each of said variable edge erase lamp means for providing an indication of proper operation of each of said lamps.

3. The invention as claimed in claim 1 wherein said copier further includes means for controlling current to a transfer and preclean corona means, and voltages to developer roll means, grid means, backcharge means, and said erase means and including the further step, before said developing step, of varying intermittently said operating voltages during operation of said copier.

4. In a copier of the electrophotostatic type having photoconductor means for receiving, during an imaging cycle, optical images from an expose lamp means and a leading edge erase lamp means, a method for testing proper operation of subsystems of said copier comprising the steps of:

operating said copier with a blank input image to be copied;

turning off said expose lamp means before said imaging cycle begins; and developing a resulting copy sheet in a normal manner, whereby said copy sheet should show a uniformly dark area when said photoconductor means contains no flaws.

5. The invention as claimed in claim 4 wherein said leading edge erase lamp means is activated before said imaging cycle begins.

* * * * *